United States Patent [19]

Holmes et al.

[11] 4,450,227

[45] May 22, 1984

[54] DISPERSED IMAGING SYSTEMS WITH TETRA (HYDROCARBYL) BORATE SALTS

[75] Inventors: Brian N. Holmes, Oakdale, Minn.; Rex J. Dalzell, Sommerset, Wis.; Steven M. Aasen, Lakeland, Minn.

[73] Assignee: Minnesota Mining and Manufacturing Company, St. Paul, Minn.

[21] Appl. No.: 436,264

[22] Filed: Oct. 25, 1982

[51] Int. Cl.[3] ..... G03C 1/72

[52] U.S. Cl. ..... 430/339; 430/340

[58] Field of Search ..... 430/339, 340, 341, 138, 430/546

[56] References Cited

U.S. PATENT DOCUMENTS

| | | | |
|---|---|---|---|
| 3,503,745 | 3/1970 | Yamada et al. | 430/343 |
| 4,003,748 | 1/1977 | Langen et al. | 430/546 |
| 4,066,568 | 1/1978 | Nakazawa | 430/138 |
| 4,307,182 | 12/1981 | Dalzell et al. | 430/339 |
| 4,343,891 | 8/1982 | Aasen et al. | 430/339 |

FOREIGN PATENT DOCUMENTS

| | | |
|---|---|---|
| 1370058 | 10/1974 | United Kingdom . |

*Primary Examiner*—Won H. Louie, Jr.

*Attorney, Agent, or Firm*—Donald M. Sell; James A. Smith; Mark A. Litman

[57] ABSTRACT

Light sensitive systems comprising a tetra(hydrocarbyl)borate and a dye may be used in the form of a dispersion, with the light sensitive borate and dye in one phase which is dispersed within a second phase.

10 Claims, No Drawings

DISPERSED IMAGING SYSTEMS WITH TETRA (HYDROCARBYL) BORATE SALTS

BACKGROUND OF THE INVENTION

This invention relates to dispersed dye bleaching image forming systems. A light sensitive system comprising a dye and a tetra(hydrocarbyl)borate is shown to have improved properties when the light-sensitive system is dispersed.

BACKGROUND OF THE INVENTION

There exists a vast array of imaging systems having a multitude of various constructions and compositions. Amongst the more widely used systems are silver halide light sensitive systems (including black and white and color photography, dry silver photothermography, instant photography, and diffusion transfer systems, amongst others), photopolymeric systems (including planographic and relief printing plates, photoresist etching systems, and imaging transfer systems), diazonium color coupling systems, and others. Each system has its own properties attributable to the phenomenon which forms the basis of the imaging technology. For example, silver halide imaging systems are noted both for amplication (i.e., image densities which can be increased by further development without additional imagewise exposure) due to the catalytic action of silver towards the reduction of silver ion and for the fact that light sensitivity may be stopped after development by washing away the light sensitive silver halide salt (i.e., fixing). Photopolymeric systems are noted for image stability and ease of application of the imaging layer. Diazonium color coupling systems have high image resolution and are easy to coat onto supporting substrates.

One other type of imaging system which has received some attention in recent years uses a salt comprising an aromatic tetra(hydrocarbyl)borate anion as a dye-bleaching or solubility-altering photosensitive compound. U.S. Pat. No. 3,567,453 discloses the use of such borate salts (having at least one aryl substituent on the borate) in photoresist and lithographic compositions. U.S. Pat. No. 3,754,921 discloses an imaging system comprising a leucophthalocyanine and "phenylboronate." U.S. Pat. No. 3,716,366 even indicates that image stabilization might be achieved by reaction or dissolution and removal of one of the components (column 5, lines 1–8). British Pat. Nos. 1,370,058; 1,370,059; 1,370,060; and 1,386,269 also disclose dye bleaching processes using aromatic borates as light sensitive agents.

U.S. Pat. No. 4,307,182 discloses that light-sensitive systems formed with tetra(aliphatic)borates are preferred dye-bleach borate systems. U.S. Pat. No. 4,343,891 teaches methods used to desensitize or fix tetra(hydrocarbyl)borate imaging systems, including those with bleachable dyes.

SUMMARY OF THE INVENTION

It has been found that light sensitive systems can be formed with dispersed tetra(hydrocarbyl)borates. It is believed that substantially all light sensitive borate systems and particularly the dye bleaching systems which previously used dissolved borates can use oil or polymer phase dispersed borates and generally confer certain advantages, such as reduction in the amount of solvent presence and facilitating the manufacture of multicolor systems. Normally incompatible color systems can be combined in a single coating layer.

Light sensitive systems using aromatic tetra(hydrocarbyl)borates are known to comprise such various constructions as 1) substrates having the borate coated directly on the surface of the substrate or in a binder (e.g., U.S. Pat. No. 3,567,453), (2) binders containing the borate and leuco forms of dyes (e.g., U.S. Pat. No. 3,754,921) (3) binders containing the borate and bleachable dyes (e.g., British Pat. Nos. 1,386,269; 1,370,058; 1,370,059; and 1,370,060), and (4) combinations of colorable organic salts and borates, with or without binders (e.g., U.S. Pat. No. 3,716,366).

DETAILED DESCRIPTION OF THE INVENTION

Borates are variously referred to in the art as borates, boronates, boronides and other chemical terms. In the practice of the present invention, borates are strictly defined as tetra(hydrocarbyl)borates; that is, a compound having four carbon-to-boron bonds. The compounds used in the present invention are tetra(hydrocarbyl)borates and preferably tetra(aliphatic)borates, wherein all of the carbon-to-boron bonds are from aliphatic groups. These compounds may be represented by the formula:

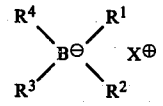

wherein $R^1$, $R^2$, $R^3$, and $R^4$ are independently any groups bonded to the boron from a carbon atom, and $X^+$ is any cation except boron to carbon bond cleaving cations (e.g., $H^+$).

The groups $R^1$, $R^2$, $R^3$, and $R^4$ may be independently selected from alkyl, aryl, alkaryl, arylalkyl, alkenyl, alkynyl, allyl, cyano, and alkyl-heterocyclic groups. Preferably there is no more than one cyano group or no cyano groups bonded to the boron. It is generally preferred that aliphatic groups such as alkyl and allyl groups be bonded to the boron. When the substituents are referred to in the practice of this invention as groups, i.e., alkyl groups versus alkyl, that nomenclature specifically is defined as allowing for substitution (other than by groups which generate $H^+$ or other fixing groups) on the alkyl moiety (e.g., ether or thioether linkages within the alkyl, halogen, cyano, acyloxy, acyl or hydroxy substitution, etc.), always providing that the alkyl group must be bonded to the boron from a carbon atom. Thus, alkoxy and phenoxy would not be included in the terms alkyl group and aryl group. Alicyclic groups are also included within the term aliphatic. Preferably no group contains more than twenty carbon atoms. More preferably they contain no more than twelve carbon atoms, and most preferably no more than eight carbon atoms. Substituents which render the groups $R^1$, $R^2$, $R^3$, and $R^4$ less electronegative are preferred. $R^1$, $R^2$, $R^3$ and $R^4$ may be aromatic groups attached through carbon atoms, although less preferred, in order to complete the definition of tetra(hydrocarbyl)borates. Such aromatic groups as phenyl, substituted phenyl, naphthyl and substituted naphthyl as known in the art are preferred in that class.

Any cation is useful except cations which break at least one carbon-to-boron bond on the borate, e.g., $H^+$. As a standard test, one could limit the cations to those which do not break at least one carbon to boron bond of tetraphenyl borate. This can be readily determined by standard analytical techniques such as gas chromatography, infrared or mass spectrometry and/or nuclear magnetic resonance. They should not be readily reducible metal cations such as $Ag^+$, $Pd^{++}$ and $Fe^{+++}$. Generally, metal ions more readily reducible than ferric ion are not desired. The nature of the cation has not been found to be otherwise critical in the practice of the present invention. The most significant contribution of the cation is its effects upon solubility in different solvents or binders. The cations may include, for example, organic cations, simple elemental cations such as alkali metal cations (e.g., $Li^+$, $Na^+$, and $K^+$) and quaternary ammonium cations, e.g., such as represented by formula:

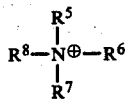

wherein $R^5$, $R^6$, $R^7$, and $R^8$ are independently selected from aliphatic (e.g., alkyl and particularly alkyl of 1 to 12 or preferably 1 to 4 carbon atoms), aryl (e.g., phenyl and naphthyl groups), and aralkyl (e.g., benzyl groups) groups. For example, tetramethyl, tetraethyl, tetrapropyl, tetrabutyl and triethylmonomethyl ammonium are particularly useful. Cations such as N-alkylpyridinium, phenyltrimethylammonium and benzyltriethylammonium are also quite satisfactory as are phosphoniums and sulfoniums. Quaternary cations in more complex forms such as quaternary dyes and quaternized groups in polymer chains are also particularly useful. The polymers, for example could contain repeating groups such as:

a.

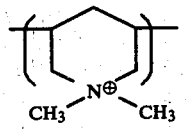

b.

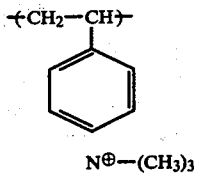

c.

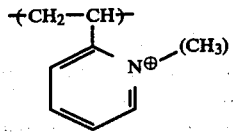

d.

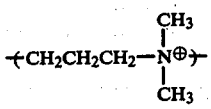

and

-continued e.

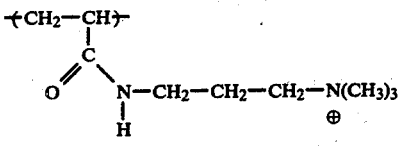

With the proper selection of quaternary ammonium cations, such polymeric materials could also serve as a binder for the system.

The dyes, for example, may be of any color and any chemical class. Any dye photobleachable by borates may be used. The dyes, of course, should not contain groups which would fix or desensitize the borate salts without light exposure (e.g., free carboxylic acid groups, free sulfonic acid groups, or readily reducible metal cations such as metal cations at least as readily reducible as ferric ion). The following are examples of dyes used in the practice of the present invention:

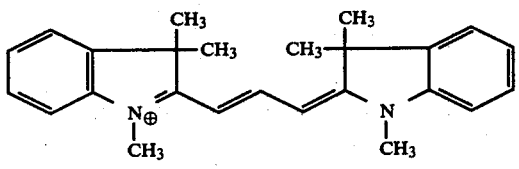

(magenta dye cation, Indolenine Red)

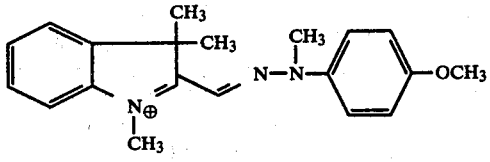

(yellow dye cation)

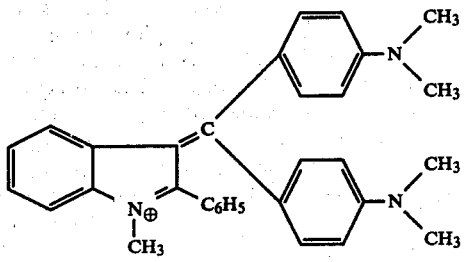

(cyan dye cation)

Cationic dyes are the most preferred, and when they have been used, a slight excess of a salt providing the borate anion is desired to provide complete bleaching.

Other cationic dyes are useful, and the dyes may have anions other than borates, such as the ionic dyes of the formula:

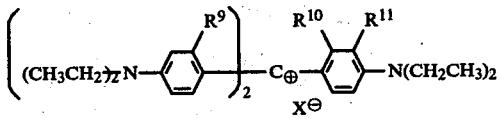

wherein $X^-$ is any anion including $Cl^-$, $I^-$, $Br^-$, perfluoro(4-ethylcyclohexane)sulfonate (hereinafter, PECHS), sulfate, methyl sulfate, methanesulfonate, etc.

$R^9$ and $R^{10}$ are independently H, alkyl or alkoxy (preferably 1 to 12 carbon atoms and most preferably 1 to 4 carbon atoms), F, Cl, Br, and I, $R^{11}$ is H or alkyl, preferably 1 to 12 and most preferably 1 to 4 carbon atoms or halogen. Virtually any cationic dye is useful in the practice of the present invention, and their listing is merely cumulative. Neutral dyes may also be used.

Imaging in the light sensitive systems comprising tetra(aliphatic)borate, dye and binder is effected by irradiation. The radiation which is absorbed by the dye-borate system causes the dye to bleach. A positive-acting imaging process is thus effected. The use of cationic dyes is believed to cause spectral absorption of radiation enabling the dyes to react with the borates. The dyes associated with the borate are not spectral sensitizers in the photographic silver halide sense and are not used as sensitizing dyes are used in photographic imaging systems (the latter are usually in ratios of 1/500 to 1/10,000 of dye to light sensitive agents). The present dyes are used in proportions of at least 1/10 to about 1/1 in ratio of the borate. Because the dye-borate system combines the spectrally sensitive element and the image-forming element at a molecular level, a multiplicity of colored dyes may be used (e.g., cyan, magenta, yellow) in the same or different layers or in dispersed particles or droplets.

The present invention is practiced by having the dye-borate system carried in one distinct phase (usually and preferably dissolved therein) and then having that phase dispersed as droplets or particles within a second distinct phase. Preferably less than 5% of the borate will be leached or migrate into that second distinct phase within one month at standard temperatures and pressure at 30% relative humidity. The general methods of effecting such a distribution of phases is well known in the art, particularly in the photographic art where color-forming couplers are first dissolved in low volatility organic solvents and then mixed with a gelatin solution to form tiny suspended droplets of the coupler carrying solvent in the gelatin binder. The well known techniques of the photographic art may be used in the practice of the present invention, for example, by first dissolving the dye and borate in a solvent and then mixing the solution with an immiscible solution of a binder, such as gelatin, to form droplets of the solution in the binder. The binder may then be hardened according to the requirements of the binder, with caution being taken to avoid a desensitizing reaction between the borate and hardener. Gelatin uses crosslinking agents, i.e. hardeners, to accomplish that, while other binders may be dried, cured, crosslinked or the like to form a dimensionally stable layer. If radiation is to be used to harden the layer, it should be of a wavelength or intensity to which the borate dye bleach system is not sensitive.

As noted previously, the dye-borate system may be carried in either a solid or liquid phase. Both of these constructions will be referred to as dispersions in view of that generally accepted practice in the photographic art even though the terms suspension or emulsion might accurately apply to different types of these constructions or at different stages of their manufacture. Preparation of a dispersion with the dye-borate in a solid phase is also relatively simple. The dye-borate is either first included in a solid phase (as by dissolving it in a polymeric binder) and then the solid is milled or ground into appropriately sized particles or it may be formed by coprecipitating the dye-borate in a polymeric phase as is done in emulsion polymerization techniques. If polymeric systems become incompatible during polymerization of one phase, it would also be possible to mix the dye-borate dissolved in a first polymer, and by stirring the mixture while polymerizing the second polymer, create a dispersed phase therein. All of these techniques can be readily appreciated by the ordinarily skilled artisan.

The size range of the dispersion particles is not critical. Ordinarily the size should be less than 50 microns and preferably less than 10 microns and will range from 0.10 to 50 microns. Preferably the range is from 0.25 to 25 microns. More preferably the range is from 0.25 to 8 microns.

Binders used in the present invention should be transparent or at least translucent. According to some practices of the present invention, the layers need not be penetrable by solvents or gases. Binders such as natural resins (e.g., gelatin, gum arabic, etc.), synthetic resins (e.g., polyacrylates, polymethacrylates, polyvinyl acetals, cellulose esters, polyamides, polycarbonates, polyolefins, polyurethanes, polyepoxides, polyoxyalkylenes, styrene/acrylonitrile copolymers, polyvinylhalides, polysiloxanes, polyvinylacetate, polyvinyl alcohol. etc.), and other media may be used. The binders may be thermoplastic or highly crosslinked.

The desensitization or fixing of the light sensitive tetra(hydrocarbyl)borates is effected by disrupting at least one of the carbon-to-boron bonds on the compound. The compound may still have four bonds to the boron, but if at least one is no longer a carbon-to-boron bond, the resulting dye-borate system will not be light sensitive and the image will be stable. The conversion of the borates having four carbon-to-boron bonds can be effected in a variety of fashions. Introducing an acid into reactive association with the tetra(hydrocarbyl)borate will effect such a conversion. This has been done for example, by subjecting the sheet to hydrochloric acid vapor, coating the sheet lightly with acetic acid, placing an acid containing polymeric sheet in temporary or permanent association with the imaging sheet and heating the composite, or including an acid-releasing light-sensitive material in the sheet and irradiating the material (where it is sensitive to a different portion of the spectrum than the dye-borate system). The useful acids include for example, carboxylic acids (e.g., acetic acid, stearic acid, salicylic acid, etc.), inorganic acids (e.g., nitric acid, sulfuric acid, hydrobromic acid, hydrochloric acid, sulfamic acid), and organic acids other than hydrocarbon carboxylic acids (e.g., aliphatic sulfonic and sulfonylic acids, fluorinated or perfluorinated carboxylic acids, etc.). Other materials which may be applied to the sheet in similar fashions include aldehydes (particularly by vapor treatment), peroxides, iodine, readily reducible metal ions, and quinones. Latent oxidants such as bisimidazoles could be used also. These materials need only be introduced into reactive association with the tetra(hydrocarbyl)borane to effect fixing. Reactive association is defined as such physical proximity between materials as to enable a chemical reaction to take place between them.

A variety of conventional additives such as surfactants, antioxidants (e.g., phenidone), ultraviolet radiation absorbers, coating aids, fillers, (e.g., glass beads, glass fibers, etc.) may be added to the compositions to obtain the benefit of their known properties. These compositions may be applied to any substrate such as clear polymeric film, paper, pigmented film, metal film or metallized film, etc.

These and other aspects of the present invention may be seen in the following examples.

EXAMPLE 1

The following three dyes were used in forming a single layer, full color, positive acting, light sensitive film according to the present invention:

Cyan

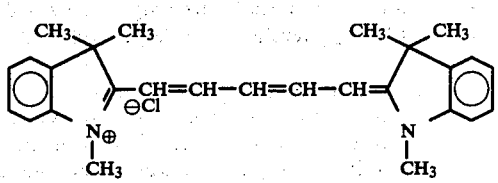

Magenta (Genacryl Pink G, Color Index 48015)

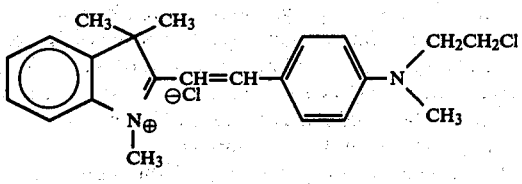

and

Yellow

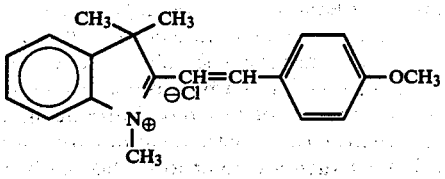

The dyes were precipitated as water-insoluble tetraphenylborate salts from warm aqueous solutions of the chloride salts of the dyes (according to the teachings of U.S. Ser. No. 152,615 filed May 23, 1980) to which an equivalent or excess amount of sodium tetraphenylborate solution had been added. The products were filtered off and air dried.

The binder solution used was a polyvinyl acetate/polyvinyl chloride copolymer (87/13) as a 10% by weight solution in methylethylketone and toluene (3/1). The dyes were used in proportions which approximated a neutal density of about 1.0 (a ratio of about 5:6:7, cyan:magenta:yellow, being used). The solution was coated on 2½ mil polyester at a 3 mil wet thickness and air dried overnight. A sample of the film was cut to a convenient size, placed in contact with a 35 mm color transparency slide, inserted into the slide position of a slide projector with a 500 watt bulb, and exposed through the transparency for 3 minutes. A full color positive image of the transparency resulted. This is an example of a dissolved dye-borate imaging material.

EXAMPLE 2

A methylene chloride solution of (indolenine red/perfluoro(4-ethylcyclohexane) sulfonate)-(tetrabutyl borate/tetrabutyl ammonium) and polymethylmethacrylate (total 6% solids, 1:10 dye-borate to polymer) was spray dried using a spray gun atomizer to form particles of 5–10 microns. These particles were dispersed into a solution of polyvinyl alcohol and the dispersion coated as a film layer and gently oven dried.

When exposed and developed as in Example 1, a magenta color positive image was produced.

EXAMPLE 3

Cyan, magenta and yellow cationic dyes plus sodium tetraphenyl borate were dissolved in an oil phase. A gelatin solution was then added slowly to the oil phase until inversion of the dispersion was complete (indicated by a consistent milky appearance) utilizing a Virtis "45" high shear mixer. After inversion, the remainder of the gelatin solution was added rapidly.

| Gel Phase Formulation | |
|---|---|
| Gelatin (Photographic grade) | 2.69 g |
| Water | 55.8 g |
| Mono-Sodium salt of dioctyl sulfosuccinate | 0.25 g |

Oil Phase Formulation 1.8 ml Dibutyl phthalate
8.0 ml Ethyl acetate
232.8 mg Sodium tetraphenyl borate
44.1 mg Cyan dye

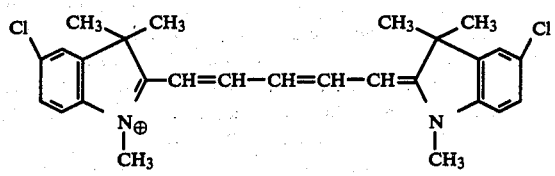

PECHS⊖
(i.e., perfluoro(4-ethylfluorocyclohexane)sulfonate)
63.0 mg magenta dye

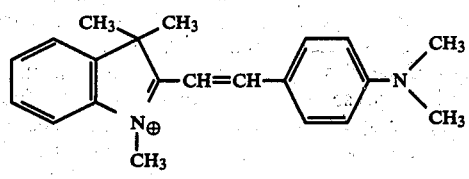

PECHS⊖
70 g yellow dye

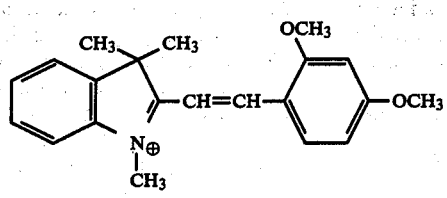

PECHS⊖

The resultant emulsion was knife-coated on photographic paper base at 3 mil wet thickness.

Optical density filter readings were made with a T/R 400 Carlson densitometer

Results: Red—0.79, Green—1.01; Blue—1.05; Visible—0.90.

A full color positive reproduction was obtained after exposure through a 35 mm color slide original as in Example 1

EXAMPLE 4

A dispersion of imageable particles in a binder was formulated by first preparing two solutions:

Solution A 200 mg Indolenine Red+PECHS−

350 mg Tetraethylammonium tetrabutylborate 9.8 ml Binder solution (5% by weight solids of methacrylic acid/methylmethacrylate copolymer in ethyl acetate).

Solution B 55 g Gelatin solution (3.75% solids gelatin in $H_2O$ at 40° C.)

1.5 ml Dioctylsulfosuccinate monosodium salt solution in ethanol (0.1 g/ml)

Solution B was added to Solution A with rapid stirring at 40° C. using a Polytron vacuum blender at a low-medium speed setting. Stirring was continued for 7 minutes after the addition was complete.

The resulting emulsion was coated onto polyester (primed with uncrosslinked gelatin) using a slip coater. The film was air dried in the dark for 2 hours. A sample of this film was imaged as in Example 1.

EXAMPLE 5

Three separate emulsions were prepared:

Emulsion 1

Solution A was identical to solution A of Example 4 except that Indolenine Yellow+PECHS− was used as the dye.

Solution B 55 g Gelatin solution (3.75% solids gelatin in $H_2O$ at 40° C.)

1.5 ml Dioctylsulfosuccinate monosodium salt solution in ethanol (0.1 g/ml)

Solution B was added to solution A with rapid stirring at 40° C. using a Virtis 45 blender at a medium speed setting. Stirring was continued for 2 minutes after the addition was complete. The solution was kept at 40° C. until Emulsions 2 and 3 were prepared.

Similarly Emulsions 2 and 3 were prepared using the following formulations:

Emulsion 2

Solution C was identical to Solution A of Example 4.

Solution D 55 g Gelatin solution (3.75% solids gelatin in $H_2O$ at 40° C.)

1.5 ml Dioctylsulfosuccinate monosodium salt solution in ethanol (0.1 g/ml)

Emulsion 3

Solution E 150 mg Indolenine Blue+PECHS−

300 mg Tetraethylammonium tributylphenylborate 9.8 ml Binder solution (5% solids MA/MMA copolymer in ethylacetate)

Solution F 55 g Gelatin solution (3.75% solids gelatin in $H_2O$ at 40° C.)

1.5 ml Dioctylsulfosuccinate monosodium salt solution in ethanol (0.1 g/ml)

Emulsions 2 and 3 were separately prepared in the same manner as Emulsion 1. Emulsions 1, 2 and 3 were then combined and coated onto gelatin primed polyester at 5 mil wet thickness using a knife coater. The resulting coating was allowed to air dry for one hour at room temperature.

The resulting film was imaged by exposure to white light through a colored original to produce a positive reproduction. The film was fixed to further bleaching by dipping the solution for ten seconds in a solution of dilute HCl and glyoxal (25 ml of 0.1 M HCl containing 1 drop of 30% glyoxal in $H_2O$). The film was air dried.

We claim:

1. A light-sensitive positive-acting imaging material comprising a first phase comprising a tetra(hydrocarbyl)borate salt in reactive association with a bleachable dye in a solid or liquid medium and said first phase dispersed in a second phase.

2. The material of claim 1 coated on a substrate.

3. The material of claim 2 wherein said first phase further comprises an organic solvent and said second phase comprises a solid organic binder.

4. The material of claim 2 wherein said first phase further comprises an organic polymeric binder and said second phase comprises a different organic polymeric binder.

5. The material of claim 3 wherein said organic solvent comprises a high temperature boiling organic solvent.

6. The material of claim 5 wherein said second phase comprises gelatin.

7. The material of claim 3 wherein two, three or four bleachable dyes are present within said first phase.

8. The material of claim 5 wherein two, three or four bleachable dyes are present within said first phase.

9. The material of claim 3 wherein said salt comprises a tetraalkyl borate salt.

10. The material of claim 5 wherein said salt comprises a tetraalkyl borate salt.

* * * * *

UNITED STATES PATENT AND TRADEMARK OFFICE

CERTIFICATE OF CORRECTION

PATENT NO. : 4,450,227

DATED : May 22, 1984

INVENTOR(S) : Brian N. Holmes, Rex J. Dalzell and Steven M. Aasen

It is certified that error appears in the above-identified patent and that said Letters Patent is hereby corrected as shown below:

Col. 7, line 51, "neutal" should read --neutral--.

Col. 8, line 37, "(4-ethylfluorocyclohexane) should read --(4-ethylperfluorocyclohexane)--.

Signed and Sealed this

*Eighteenth* Day of *June 1985*

[SEAL]

*Attest:*

DONALD J. QUIGG

*Attesting Officer*

*Acting Commissioner of Patents and Trademarks*